United States Patent [19]

Kwok

[11] Patent Number: 4,501,394

[45] Date of Patent: Feb. 26, 1985

[54] SPRAY GUN AIR CAP AND METHOD OF MAKING

[75] Inventor: Kui C. Kwok, Arden Hills, Minn.

[73] Assignee: Graco Inc., Minneapolis, Minn.

[21] Appl. No.: 492,840

[22] Filed: May 9, 1983

[51] Int. Cl.[3] ..... B05B 1/28

[52] U.S. Cl. ..... 239/296; 29/157 C

[58] Field of Search ..... 239/296, 424, 424.5, 239/DIG. 14, 300, 301, 290, 705; 29/157 C

[56] References Cited

U.S. PATENT DOCUMENTS

| | | | |
|---|---|---|---|
| 923,910 | 6/1909 | Thompson | 239/341 |
| 1,531,986 | 3/1925 | Shelburne | 239/301 |
| 1,661,239 | 3/1928 | Stephan | 239/301 |
| 2,052,622 | 9/1936 | Hale | 239/416.4 |
| 2,348,568 | 5/1944 | Pellar | 239/300 |
| 2,470,718 | 5/1949 | Peeps | 239/300 |
| 2,715,046 | 8/1955 | Ackerman | 239/300 |
| 2,895,685 | 7/1959 | Peeps | 239/424 |
| 4,171,096 | 10/1979 | Welsh et al. | 239/291 |
| 4,273,293 | 6/1981 | Hastings | 239/705 |

*Primary Examiner*—Andres Kashnikow
*Assistant Examiner*—James R. Moon, Jr.
*Attorney, Agent, or Firm*—Paul L. Sjoquist

[57] ABSTRACT

A spray gun nozzle including a threadably attached cap having a plurality of air passages therein, centered about an axial fluid passage and orifice, including an orifice locating disc affixed in the cap for precisely axially locating the fluid orifice relative to the axis of the air cap and for precisely defining an annular air passage surrounding the orifice. The method includes the steps of simultaneously making the orifice locating hole and the annular air passage in a single drilling operation.

7 Claims, 8 Drawing Figures

SPRAY GUN AIR CAP AND METHOD OF MAKING

BACKGROUND OF THE INVENTION

The present invention relates to fluid spray guns, and more particularly to fluid spray guns utilizing compressed air through selectively placed passages to properly atomize and shape the atomized fluid discharged from the spray gun. The invention specifically relates to a method for precisely fixing an annular air passage about an axially disposed fluid orifice, and the apparatus resulting therefrom.

Paint spray guns utilizing compressed air as an aid in the atomization and control of the spray pattern are well known in the prior art. Such spray guns utilize critically placed air passages to direct air at the fluid jet emitted from the front of the spray gun, to break up the jet into very fine droplets, and also to form the droplets into an acceptable pattern for spraying. These air passages are utilized to form a generally elliptically shaped spray pattern, which has gained acceptance in the painting industry as enabling a uniform distribution of paint on an article to be coated. The number and type of such air passages has been varied, depending upon individual spray gun designs and manufacturer preferences, although certain similarities are usually found in air spray guns regardless of the manufacturer. For example, it has become generally accepted by the industry to provide forwardly projecting horns in front of the fluid orifice, with the horns having one or more air passages for directing air flow toward the atomized paint particles, thereby serving to shape the particles into the desired spray pattern. Further, a great many manufacturers utilize an annular air passage axially surrounding the fluid orifice to provide a source of compressed air for initially atomizing the paint in the fluid orifice as it is emitted from the orifice. Still further, many manufacturers provide additional passages more or less diametrically opposed about the fluid orifice to provide additional atomization and shaping air for the paint spray pattern.

Of all of the air passages associated with an air spray gun, perhaps the most critical passage is the annular spray passage which typically surrounds the fluid orifice. In the usual construction, the fluid orifice projects through the front of the spray nozzle by a short distance, and is surrounded by an annular air gap which passes pressurized air. The air must be equally distributed about this annular air gap in order that the fluid stream can be evenly atomized and some form of spray pattern control can be maintained. The coaxial alignment of this annular air gap with the fluid orifice is extremely critical, because even extremely small amounts of coaxial misalignment result in significant unbalances in the delivery of pressurized air about the air gap, causing the atomized spray pattern to deflect off-axis by significant amounts. If the spray pattern is deflected off-axis, the air passages associated with shaping the spray pattern into desired form produce spray pattern distortion, with the result that the spray gun is essentially nonfunctional for its intended purpose. Therefore, a great amount of attention has been devoted to the problem of coaxially aligning the fluid orifice and the annular spray gap around the orifice. For example, U.S. Pat. No. 2,715,046, issued Aug. 9, 1955 discloses a spray nozzle having an adjustable aperture for properly coaxially positioning the fluid spray orifice with respect to the annular air gap. Yet another approach is disclosed in U.S. Pat. No. 4,273,293, issued June 16, 1981, wherein the fluid orifice is retained in coaxial position by radially extending ribs and a plurality of circumferentially spaced passages between the ribs. In this patent, the coaxial annular air gap is sacrificed to some extent in order that the fluid orifice may be properly centered with respect to a plurality of individual circumferentially aligned air passages. Of necessity, these individual air passages must be constructed of quite small size, and are therefore subject to clogging to a greater extent than a larger air passage might be subjected.

It is therefore desirable to provide a spray gun having a precisely located annular air gap about a fluid orifice in coaxial arrangement, wherein air is evenly distributed about the fluid orifice. Further it is desirable to construct an air cap having such characteristics according to as simple and economical a process as possible.

SUMMARY OF THE INVENTION

The present invention includes a method of constructing an air cap having a coaxial annular air gap precisely aligned about a fluid orifice in a few simple steps. The invention also includes an apparatus constructed according to the method, wherein the fluid orifice is exactly coaxially aligned within the annular air gap, by utilizing a disc which is press-fit into an air cap at a spaced-apart distance from the front wall of the air cap, and drilling, in a single operation, an axial hole through both the disc and the front wall of the air cap, and inserting the fluid orifice through the two holes, wherein the orifice is mechanically aligned by seating in the disc hole and coaxially aligned within an air gap formed between the inner wall of the second hole and the outer wall of the fluid orifice.

It is therefore a principal object of the present invention to provide a precisely aligned coaxial air gap about a fluid orifice.

It is another object of the present invention to provide a method for precisely aligning a fluid orifice within and coaxial to an annular air gap.

It is another object of the present invention to provide a method of construction and apparatus for economically providing a coaxial air gap and fluid orifice in a spray gun air cap.

BRIEF DESCRIPTION OF THE DRAWINGS

The foregoing and other objects and advantages of the invention will become apparent from the following specification and claims, and with reference to the appended drawings, in which:

DESCRIPTION OF THE PREFERRED EMBODIMENT

Figure 1:
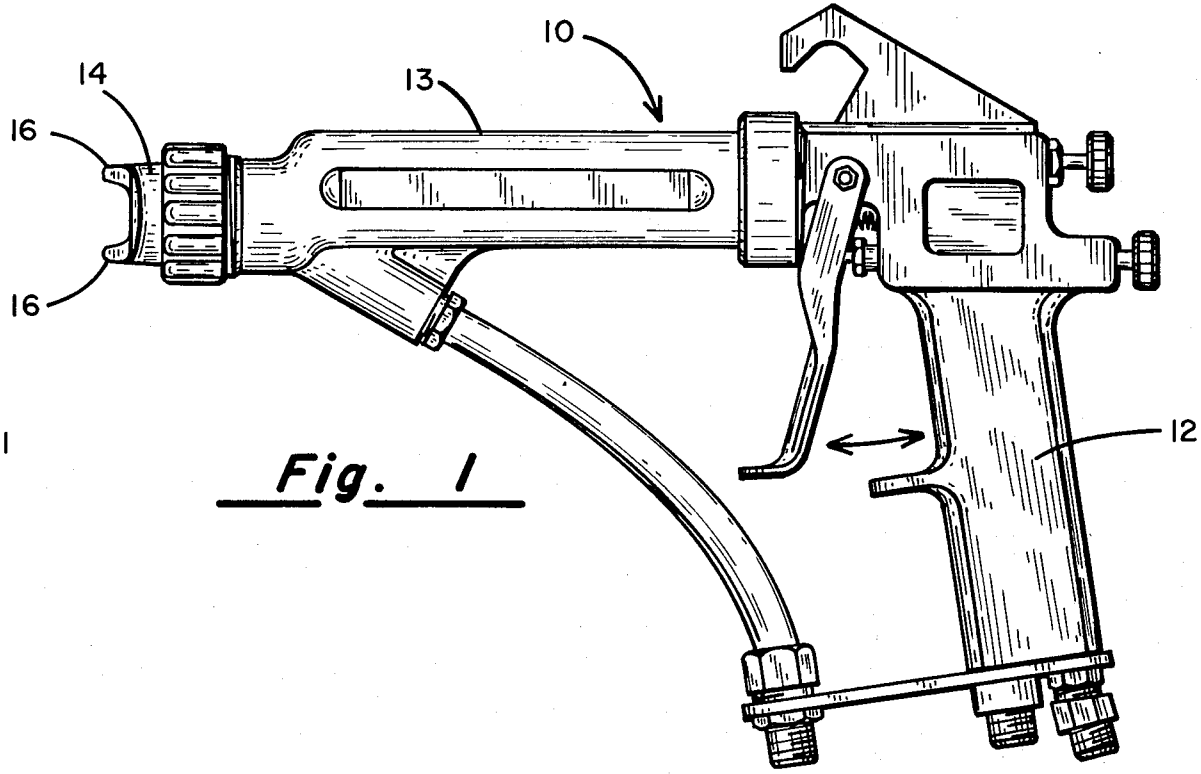
FIG. 1 shows a spray gun of the type for which the invention is adapted.

Referring first to FIG. 1, there is shown a spray gun 10 of the type generally adapted for use with the present invention. Spray gun 10 has a handle 12, a gun body 13 and a nozzle 14. Nozzle 14 has projecting horns 16 which will be hereinafter described.

Figure 2:
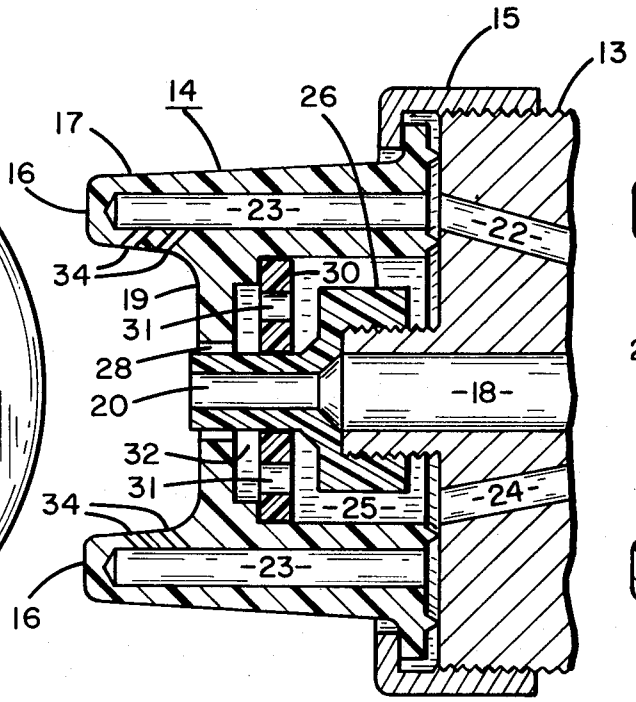
FIG. 2 shows a cross sectional view of a spray gun air cap having the invention incorporated therein.

FIG. 2 shows an expanded and cross sectional view of the nozzle 14, which includes an air cap 17 which is threadably secured against gun body 13 by means of a threaded cap nut 15. Air cap 17 has a pair of projecting horns 16 which communicate with an internal chamber 23. Chamber 23 is in flow communication with air passage 22 when air cap 17 is secured against spray gun body 13. A spray tip 26 is threadably attached to the front of body 13, and has a forwardly projecting fluid orifice 20. A fluid passage 18 is axially aligned in gun body 13, and spray tip 26 is axially threaded on gun body 13 so as to form an extension of fluid passage 18 which terminates at fluid orifice 20.

Air cap 17 has a front wall 19 which closes about spray tip 26. An opening in front wall 19 which is sized larger than fluid orifice 20 provides an annular air passage 28 which circumferentially surrounds fluid orifice 20. Air gap 17 has an internal shoulder against which a disc 30 is press-fit. An intermediate chamber 32 is formed in the air space between the position of disc 30 and the front wall 19 of air cap 17. Disc 30 has a plurality of openings 31 which provide air flow communication between intermediate chamber 32 and nozzle chamber 25. Nozzle chamber 25 is in flow communication with air passage 24.

Air passages 22 and 24 are formed within spray gun 10, and are connectible to a source of pressurized air. Air passages 22 and 24 may have individual air flow control valves associated therewith, so as to provide individual regulation of the pressurized air respectively passing therethrough. Alternatively, air passages 22 and 24 may be connected to a single air inlet on spray gun 10, to receive a common pressurized air supply.

Projecting horns 16 have a plurality of air passages 34 which permit the escape of air from chamber 23 to the region generally downstream of fluid orifice 20. Horn air passages 34 are usually directed forwardly and serve to assist the shaping of the spray pattern which is emitted from the spray gun. By contrast, annular air passage 28 is primarily utilized to atomize the fluid emitted from fluid orifice 20, and its coaxial position relative to fluid passage 18 permits the fluid to be equally atomized about the circumference of fluid orifice 20.

Figure 5:
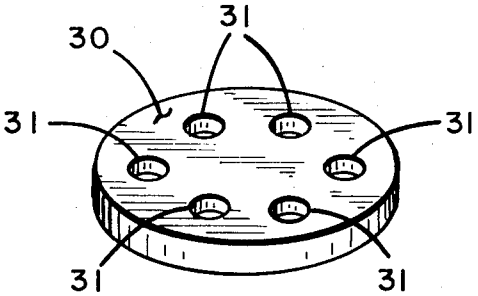
FIG. 5 shows an isometric view of one part of the invention.
Figure 3:
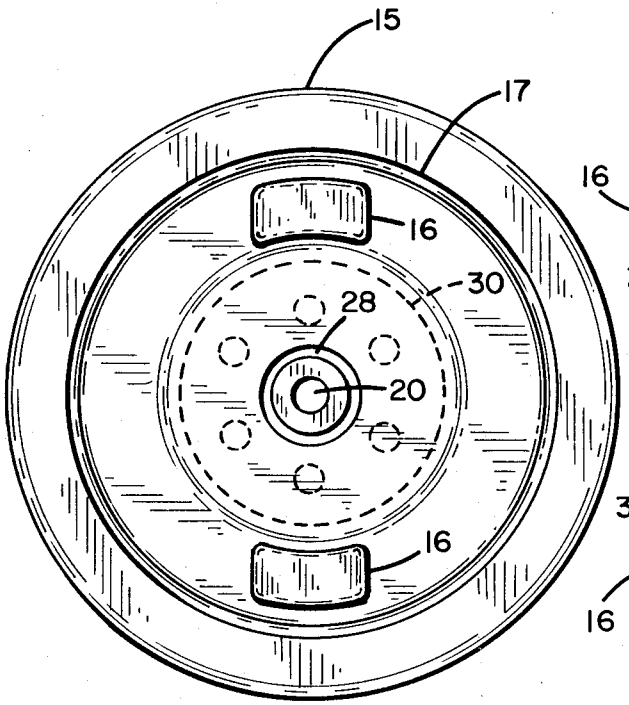
FIG. 3 shows a front view of the air cap of FIG. 1.

Referring next to FIG. 3, there is shown a front view of nozzle 14 of spray gun 10. Projecting horns 16 are diametrically spaced above and below fluid orifice 20. Fluid orifice 20 is coaxially precisely aligned with air passage 28, and forms an extension of fluid passage 18 from within spray gun 10. Disc 30 is shown in dotted outline form, and FIG. 5 illustrates disc 30 prior to the completion of the manufacturing steps recited herein. Disc 30 is preferably made from a nylon or plastic material, having a plurality of openings 31 therethrough, and initially having no center hole drilled through its axis. The drilling of the center hole comprises a step in the method of manufacturing as will be hereinafter described.

Figure 4:
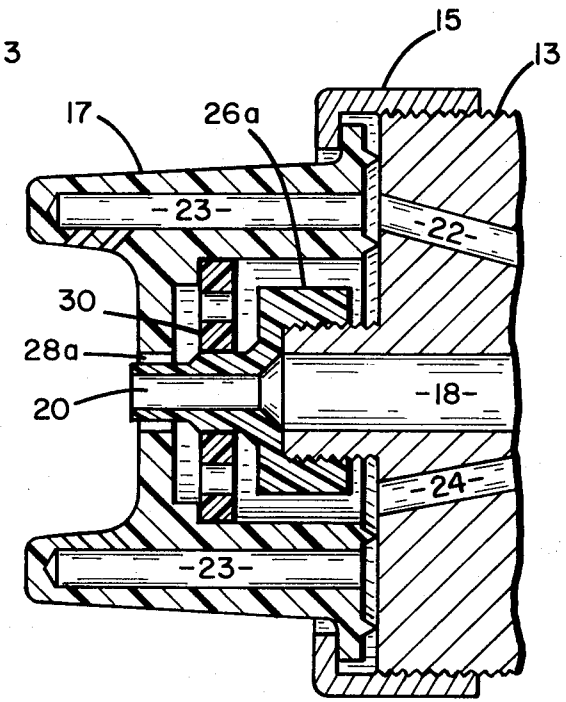
FIG. 4 shows a cross sectional view of an alternative embodiment of the invention.

FIG. 4 shows an alternative embodiment of the nozzle 14 of spray gun 10. FIG. 4 is identical to FIG. 2 in all respects, except the construction of spray tip 26 and the method of creating annular air passage 28 through the front wall 19 of air cap 17. In FIG. 4, the spray tip is referred to by the numeral *26a*, and the air passage is referred to by the numeral *28a*, to indicate differences in their construction as will be hereinafter described in more detail.

Figure 6:
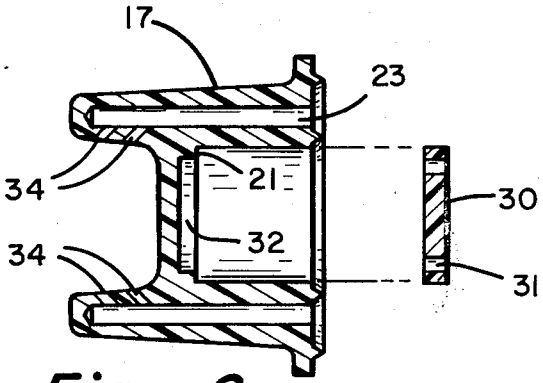
FIG. 6 shows a cross section of an air cap during one step of manufacture.

FIG. 6 shows a side cross sectional view of air cap 17 at a preliminary stage of manufacture according to the method to be hereinafter described. Air cap 17 is preferably formed through a molding process of nonconductive material such as plastic, and initially contains the interior air cap chamber 23 and passages 34. FIG. 6 also shows a side cross sectional view of disc 30 at the same preliminary stage of manufacture. Disc 30 is also preferably formed of nonconductive material such as plastic in a molding process, and initially contains a plurality of openings 31 as described hereinbefore, but does not contain any center opening.

Figure 7:
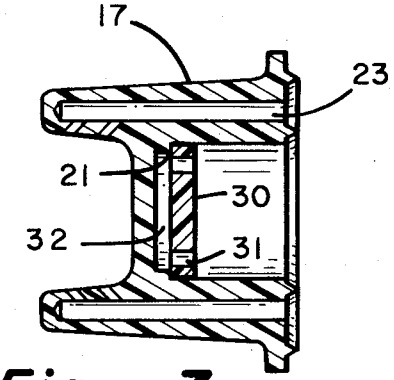
FIG. 7 shows a cross section of a part of the invention during a second step of manufacture.

FIG. 7 shows a stage of manufacture wherein disc 30 is press-fit into contact against a shoulder 21 formed on air cap 17. This press-fit connection is sufficient to securely hold disc 30 in tight, nonrotating position inside of air cap 17 as shown. The space between disc 30 and front wall 19 of air cap 17 is thereby formed, to create intermediate chamber 32 as has been described herein.

Figure 8:
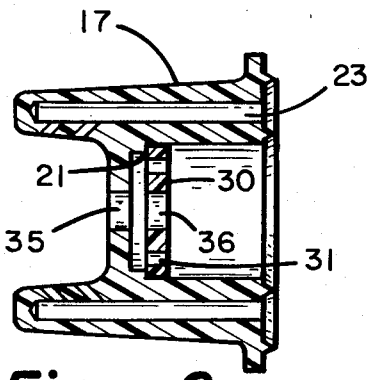
FIG. 8 shows a third step of manufacture.

FIG. 8 shows a subsequent stage of manufacture wherein a hole 35 has been drilled through front wall 19 of air cap 17, and a hole 36 has been drilled through the center of disc 30. Holes 35 and 36 are constructed during the same drilling operation, so as to ensure that both holes are identically axially aligned. The particular technique used to drill holes 35 and 36 may vary as the construction of the final air cap is preferred. For example, if the air cap embodiment of FIG. 2 is constructed, holes 35 and 36 are drilled using a step drill tool, wherein the holes are identically axially aligned, but hole 35 is made slightly enlarged as compared with hole 36. In the alternative, if the embodiment shown in FIG. 4 is to be constructed holes 35 and 36 may be drilled in a single drilling operation of the same diameter, for in this instance it is the spray tip *26a* which is formed to construct the necessary air passage *28a*. In either event, after the drilling operation has been completed, holes 35 and 36 are precisely and identically axially aligned, hole 36 being sized to accept the neck of spray tip 26 (*26a*) in a snug seating arrangement. This method of construction ensures coaxial alignment of the fluid orifice 20 relative to the fluid passage 28 (*28a*), regardless of whether there is axial misalignment of any of the threaded members by virtue of thread tolerances, etc.

In operation, the method of the present invention is performed according to the steps illustrated in FIGS. 6–8, wherein disc 30 is compressibly inserted into air cap 17 to form a tight-fitting mechanical connection, and a single drilling operation forms holes 35 and 36 through front wall 19 and disc 30. Finally, air cap 17 is threadably clamped against the front of spray gun 10 by means of cap nut 15, after spray tip 26 (*26a*) has been threadably attached to the front of spray gun 10.

The operation of the apparatus permits the passage of pressurized air through the internal spray gun passages 22 and 24, which in turn are coupled to the passages described herein, to ensure that the fluid emitted from fluid orifice 20 is correctly atomized and the atomized spray is correctly shaped. The critical alignment of the components described herein, by virtue of the method described herein, ensures that the annular air passage 28

(28*a*) cannot be constructed in a manner which is not in coaxial alignment with fluid orifice 20.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In an air spray gun of the type having air passages arranged in a nozzle around an axially positioned fluid passage for atomizing the fluid emitted therefrom, the improvement in coaxially aligned fluid and air passages comprising (a) an opening axially aligned in said nozzle;

(b) an insert in said nozzle in coaxial alignment with said opening and spaced from said opening, said insert having an axial opening therethrough;

(c) a spray tip having an orifice opening projecting through said axial nozzle opening, said spray tip being sized smaller than said axial nozzle opening, said spray tip also projecting through said insert axial opening in tight fitting relationship; and (d) an axially concentric annular opening formed between said spray tip and said axial nozzle opening, said annular opening and said insert axial opening being precisely and exactly formed by a simultaneous drilling operation through said nozzle and said insert whereby said spray tip is precisely axially contained within said insert opening.

2. The apparatus of claim 1, further comprising an air chamber between said insert and said axially symmetric annular opening, and a plurality of openings through said insert.

3. The apparatus of claim 2, wherein said axially aligned opening in said nozzle and said axial insert opening are simultaneously formed in a single drilling operation.

4. An air spray nozzle of the type adapted for use in a paint spray gun, having an axially positioned spray tip fixed in precise coaxial alignment within an annular air passage according to the method of manufacture comprising the steps of (a) forming an air chamber in said nozzle intermediate two spaced apart walls;

(b) drilling an axial hole through both of said walls in a single drilling operation; and (c) inserting a spray tip through said holes whereby the spray tip size substantially fills one of said holes and is substantially smaller than the other of said holes.

5. The air spray nozzle of claim 4, wherein said step of drilling further comprises drilling two holes of unequal size.

6. The air spray nozzle of claim 4, wherein said step of drilling further comprises drilling two holes of equal size.

7. An air spray nozzle having precise coaxial alignment of an annular air passage about a fluid spray orifice, manufactured by the steps of (a) forming a nozzle having a forward wall and an interior recess behind said forward wall;

(b) inserting a further wall member in said recess in spaced apart relation from said forward wall;

(c) drilling an opening through both of said walls in a single drilling operation;

(d) inserting a spray tip in and projecting through said further wall and through said forward wall, said spray tip being sized to substantially fill said opening in said further wall and being sized smaller than said opening in said forward wall.

* * * * *